US005901859A

United States Patent [19]

Carr et al.

[11] Patent Number: 5,901,859

[45] Date of Patent: May 11, 1999

[54] CARD DISPLAY UNIT AND METHOD

[75] Inventors: Arthur G. Carr, Washington, D.C.; Sally G. Bloomberg; David A. Hindin, both of 6612 Rosecroft Pl., Falls Church, Va. 22043

[73] Assignees: Sally G. Bloomberg; David A. Hindin, both of Falls Church, Va.

[21] Appl. No.: 08/922,380

[22] Filed: Sep. 3, 1997

[51] Int. Cl.[6] ..... A47F 7/16

[52] U.S. Cl. ..... 211/45

[58] Field of Search ..... 211/45; 403/217, 403/170, 174; 40/124, 124.4, 658, 666, 729, 730; 248/316.7; 24/300, 462

[56] References Cited

U.S. PATENT DOCUMENTS

| | | | |
|---|---|---|---|
| D. 253,540 | 11/1979 | Rothchild . | |
| 1,997,048 | 4/1935 | Demmy . | |
| 3,524,275 | 8/1970 | Korth . | |
| 3,528,559 | 9/1970 | Miller | 211/184 |
| 3,599,360 | 8/1971 | Lappo . | |
| 3,789,526 | 2/1974 | Lavinson . | |
| 3,797,795 | 3/1974 | Hemgren | 248/316.7 |
| 3,958,696 | 5/1976 | Leonas . | |
| 4,010,517 | 3/1977 | Kapstad | 211/45 |
| 4,017,991 | 4/1977 | Berger . | |
| 4,202,121 | 5/1980 | Maris et al. . | |
| 4,326,349 | 4/1982 | Daughtry . | |
| 4,475,659 | 10/1984 | Wells et al. . | |
| 4,486,032 | 12/1984 | Leahy . | |
| 4,493,495 | 1/1985 | Linn . | |
| 4,557,064 | 12/1985 | Thompson . | |
| 4,629,075 | 12/1986 | Hutten . | |
| 4,852,280 | 8/1989 | Beattie . | |
| 4,899,974 | 2/1990 | Wear et al. . | |
| 4,993,560 | 2/1991 | Jaffe . | |
| 5,088,216 | 2/1992 | Wasilko . | |
| 5,175,913 | 1/1993 | Mackie et al. . | |
| 5,275,367 | 1/1994 | Frye . | |
| 5,335,796 | 8/1994 | Sanford et al. . | |
| 5,480,036 | 1/1996 | Opar . | |
| 5,495,644 | 3/1996 | Mesher et al. . | |
| 5,509,634 | 4/1996 | Gebka et al. . | |
| 5,555,606 | 9/1996 | Chu . | |

FOREIGN PATENT DOCUMENTS

| | | |
|---|---|---|
| 2129296 | 5/1984 | United Kingdom . |

OTHER PUBLICATIONS

Catalog for World Plastic Extruders, Inc., Moonachie, New Jersey, pp. 2 and 3. (No date available.)

Catalog for Outwater Plastics Industries, Extrusion Supplement 1997, Wood–Ridge, New Jersey, entire catalog.

*Primary Examiner*—Alvin Chin-Shue
*Assistant Examiner*—Sarah Purol
*Attorney, Agent, or Firm*—Nixon & Vanderhye P.C.

[57] ABSTRACT

A display unit for displaying sheet materials includes a channel support member and a plurality of channel members connected to the channel support member. Each of the channel members includes a pair of channel arms defining a channel shape. The channel arms extend outward from the base point and converge at a contact point disposed between a base point and distal ends of the channel arms. The channel arms preferably diverge beyond the contact point such that the distal ends are flared. Preferably, the channel members are formed integral with the channel support member by being extruded or cast from a plastic or other material. The display unit has a simple construction and is thus easy and inexpensive to manufacture. The display unit can be used laying flat, standing vertically, or hanging. The display unit can display multiple items and the items can be of various sizes, shapes and orientations.

20 Claims, 1 Drawing Sheet

FIG. 1
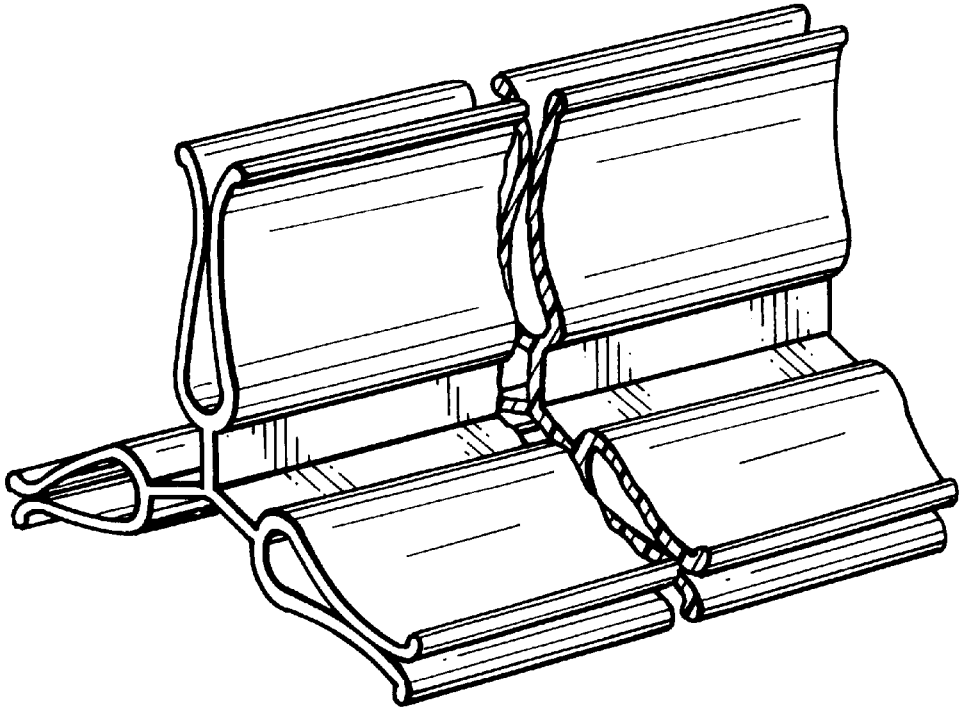
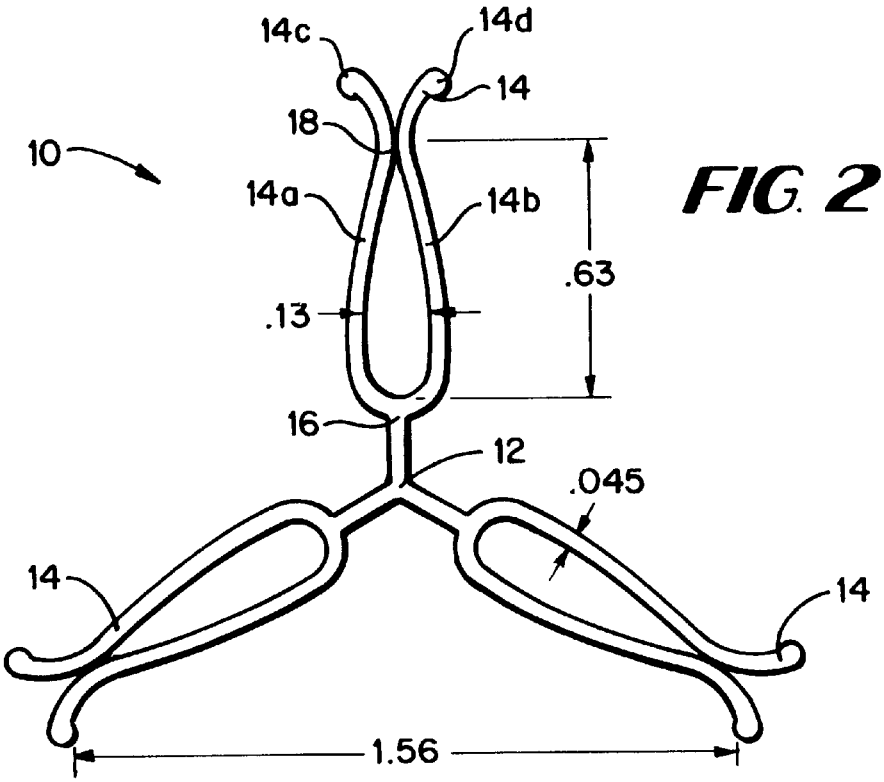
FIG. 2

CARD DISPLAY UNIT AND METHOD

BACKGROUND OF THE INVENTION

The present invention relates to a card display unit and a method of manufacturing the card display unit and, more particularly, to a display unit and method of manufacture for displaying sheet materials and having channel members extending from a base point and converging at a contact point disposed between the base point and distal ends.

A display unit for sheet materials such as cards, notes, photos, and the like has both residential, office and other applications. In the home, for example, such a display unit can be used as an art piece supporting children's art, greeting cards, playing cards, recipes and/or pictures, etc. Conventional display units, however, typically utilize complex structural configurations, requiring a complicated manufacturing process, thereby increasing product costs of production. Such units are bulky, hence difficult for sellers and consumers to store. Moreover, the prior art products can be used in only one position, i.e., they typically sit on a table. These devices also lack the flexibility to display items of different sizes, shapes and configurations simultaneously such that they can be viewed in the correct position.

U.S. Pat. No. 4,852,280 discloses a display unit having a central core member upon which a cord is wrapped in successive loops. The spines of greeting cards are inserted under individual strands of the cord for display. Unlike the current invention, this device has several limitations. First, it cannot display items that lack spines (such as photographs) since without a spine the device cannot hold the item. Second, this device is limited in that it can only display cards in one orientation, yet greeting cards come in vertical and horizontal orientations. Thus, some cards will not be displayed properly by this device. Third, the cylindrical display structure results in the cards obstructing each other such that the fronts of the cards cannot be seen without moving them. Fourth, the cylindrical display structure is bulky, requiring a large amount of horizontal space to use and store.

U.S. Pat. No. 3,789,526 discloses a similar greeting card display device which has similar limitations. U.S. Pat. No. 5,088,216 discloses another similar display device.

U.S. Pat. No. 4,326,349 describes an apparatus for displaying a plural leafed greeting card. Two leaf supports are connected together at a desired display angle by a hinge. The leaf supports respectively receive each half of the greeting card and are transparent on one or both faces to allow display of one or both sides of the greeting cards. In contrast with the current invention, this device only displays one greeting card.

It is also known to utilize multi-channel clamp molding to bind plural sheets of paper and the like. Although the clamp molding structure is typically simple in construction and inexpensive to manufacture, conventional clamp molding is not suitable for use as a display unit. For example, one such molding is known having plural channels equally spaced around a central channel support member. In the known arrangement, the channels are not centered relative to the channel support member, which affects the channels' ability to retain the sheet materials, and the arms defining each channel do not define a contact point near their distal ends, thereby also affecting their ability to retain sheet materials as well as rendering it difficult to insert the documents in the channels. Other examples are disclosed in U.S. Pat. Nos. 5,555,606, 4,899,974 and 4,010,517. These devices, however, are not suitable for use as a display unit and/or are similarly of too complex construction and are thereby expensive to manufacture.

SUMMARY OF THE INVENTION

An object of the invention is to provide a display unit and method of manufacturing therefor that is simple in construction and thus easy and inexpensive to manufacture. It is another object of the invention to provide a display unit and method of manufacturing therefor that utilizes a channel molding-like structure configured for easy insertion and removal of display items therein, without damaging the items, while securely holding the display items in place.

These and other objects of the invention are achieved by providing a display unit for displaying sheet materials including a channel support member and a plurality of channel members connected to the channel support member. Each of the channel members preferably includes a pair of channel arms defining a channel shape, wherein the channel arms extend outward from a base point and converge at a contact point disposed between the base point and distal ends of the channel arms. In accordance with other preferred aspects of the invention, the channel members are formed integral with the channel support member by being extruded or cast from a plastic, metal or other material. The channel arms preferably diverge beyond the contact point such that the distal ends of the channel members are flared. The flared ends provide a lead in to facilitate insertion of the sheet materials. The channel support member is preferably attached to the channel members at the base point of each of the channel members, respectively. The channel arms may extend substantially symmetrically outward from the base point.

In accordance with another aspect of the invention, there is provided a method of manufacturing a display unit for displaying sheet materials. The method includes the steps of attaching the channel members to the channel support member and forming the channel members with a pair of channel arms defining a channel shape such that the channel arms extend outward from a base point and converge at a contact point disposed between the base point and distal ends of the channel arms.

In accordance with still another aspect of the invention, there is provided a display unit for displaying sheet materials including a channel support member and a plurality of channel members each including a base point and a distal end. The channel members are connected to the channel support member at the base point, respectively, and define a contact point between the base point and the distal end.

By virtue of the structure of the present invention, an inexpensive and easy to manufacture display unit is provided that is structured to facilitate insertion of the display items while securely holding the display items in place. Items can be inserted and removed without being damaged. The device can be used in several different orientations including laying flat, standing vertically or hanging, and can aesthetically display only a few items or many items. Moreover, the display items themselves form the display, and the display unit becomes virtually invisible. Additionally, the display unit is portable and easily stored and can be moved with the display items intact, without disrupting the display. Further, the invention can display items of various shapes, sizes, and orientations simultaneously.

BRIEF DESCRIPTION OF THE DRAWINGS

These and other aspects and advantages of the present invention will be described in detail with reference to the accompanying drawings, in which:

FIG. 1 is a perspective view of the display unit according to the present invention; and FIG. 2 is a cross-sectional view of the display unit according to the invention.

DETAILED DESCRIPTION OF PREFERRED EMBODIMENTS

FIGS. 1 and 2 illustrate the display unit according to the present invention. The invention will be described with reference to the unit's ability to support sheet materials such as greeting cards, note cards, pictures, artwork, and like display items. Of course, those of ordinary skill in the art will contemplate alternative display items suitable for display by the display unit according to the present invention, and the above list of sheet materials is not meant to be limiting.

Referring to FIGS. 1 and 2, the display unit 10 according to the present invention includes a channel support member 12 and a plurality of channel members 14 connected to the channel support member 12. In preferred forms, the channel members 14 are formed integral with the channel support member 12, for example, by extruding or being molded or cast from a plastic or like material. In the extrusion process, the length of the display unit can be selected as desired. The material for the channel may be opaque or may alternatively be formed with a translucent or transparent material. The translucent or transparent material prevents the device from interfering with or obstructing the display items.

The display unit 10 in FIGS. 1 and 2 is shown with three channel members 14 disposed about 120° apart from one another, although any number of channel members may be formed with the channel support member 12, and the invention is not meant to be limited to the illustrated embodiment. In this context, the channel support member 12 is preferably substantially Y-shaped.

Each of the channel members 14 includes a pair of channel arms 14*a,* 14*b* defining a channel shape. As shown in FIG. 2, the channel arms 14*a,* 14*b* extend preferably substantially symmetrically outward from a base point 16 and converge at a contact point 18, which is disposed between the base point 16 and distal ends 14*c,* 14*d* of the channel arms 14*a,* 14*b,* respectively. The channel arms 14*a,* 14*b* diverge beyond the contact point 18 such that the distal ends 14*c,* 14*d* defining the distal end of the channel member 14 are flared. The flared ends 14*c,* 14*d* of the channel members 14 permit easy insertion and removal of the sheet materials.

The channel shape is preferably substantially teardrop shaped as shown in FIG. 2, although other shapes are possible. By virtue of the teardrop shape, the clamping force of the channel members 14 can be maximized while enabling the channel members 14 to support a plurality of sheet materials of varying thicknesses without exceeding an elastic limit of the channel members 14. In this manner, when the sheet materials are removed from the display unit 10, the channel members 14 elastically return to their original position with the channel arms 14*a,* 14*b* converged at the contact point 18.

The device can be used in various ways including horizontally, vertically and hanging. In the horizontal arrangement, it is preferred that the device include three or five channel members to improve functionality. With respect to hanging, any suitable hanging structure 20 can be applied to the display unit 10, such as a hole drilled (or placed in the case of molding) into a portion of the display unit 10, an auxiliary piece attached to the top portion of the display unit 10, or a string wrapped around the display unit. In an alternative arrangement, the display unit 10 according to the invention may be incorporated with a base (not shown) that would allow the device to rotate or spin when in a vertical or horizontal position.

In one further alternative arrangement, decorative enhancements may be added to the channel members 14 such as shapes on the outer edges (e.g., hearts, trees, etc.). If the device is extruded, the shapes could be added after production, and if the device is cast or molded, the shapes could be formed into the channel members 14 in a single production step.

By virtue of the structure according to the present invention, a display unit is provided that is simple in construction and thereby inexpensive to manufacture while securely and aesthetically displaying sheet materials. The flared ends of the channel members provide easy insertion and removal of the sheet materials.

While the invention has been described in connection with what is presently considered to be the most practical and preferred embodiments, the invention is not to be limited to the disclosed embodiments, but on the contrary, is intended to cover various modifications and equivalent arrangements included within the spirit and scope of the appended claims.

What is claimed is:

1. A display unit for displaying sheet materials comprising:

a channel support member; and a plurality of channel members connected to said channel support member, each of said channel members including a pair of channel arms defining a channel shape, wherein said channel arms extend outward from a base point and converge at a contact point disposed between said base point and distal ends of said channel arms.

2. A display unit according to claim 1, wherein said channel members are formed integral with said channel support member.

3. A display unit according to claim 2, wherein said channel support member and said channel members are extruded from a plastic material.

4. A display unit according to claim 2, wherein said channel support member and said channel members are cast from a plastic material.

5. A display unit according to claim 1, wherein said channel shape is substantially tear-drop shaped.

6. A display unit according to claim 1, wherein said channel arms diverge beyond said contact point such that said distal ends are flared.

7. A display unit according to claim 1, comprising three channel members disposed about 120° apart from one another.

8. A display unit according to claim 7, wherein said channel support member is substantially Y-shaped.

9. A display unit according to claim 8, wherein said channel support member is attached to said channel members at said base point of each of said channel members, respectively.

10. A display unit according to claim 1, wherein said channel support member is attached to said channel members at said base point of each of said channel members, respectively.

11. A display unit according to claim 1, wherein said channel arms extend substantially symmetrically outward from said base point.

12. A display unit according to claim 1, further comprising means for hanging the display unit.

13. A method of manufacturing a display unit for displaying sheet materials, the display unit including a channel support member and a plurality of channel members, the method comprising:

(a) attaching the channel members to the channel support member; and (b) forming the channel members with a pair of channel arms defining a channel shape such that the channel arms extend outward from a base point and converge at a contact point disposed between the base point and distal ends of the channel arms.

14. A method according to claim 13, wherein steps (a) and (b) are performed simultaneously.

15. A method according to claim 13, wherein steps (a) and (b) are performed simultaneously by extruding.

16. A method according to claim 13, wherein steps (a) and (b) are performed simultaneously by casting.

17. A method according to claim 13, wherein step (b) comprises diverging the channel arms beyond the contact point such that the distal ends are flared.

18. A display unit for displaying sheet materials comprising:

a channel support member; and a plurality of channel members each including a base point and a distal end, said channel members being connected to said channel support member at said base point, respectively, and defining a contact point between said base point and said distal end.

19. A display unit according to claim 18, wherein each of said channel members is flared at said distal end.

20. A display unit according to claim 18, wherein said channel members are formed integral with said channel support member.

* * * * *

UNITED STATES PATENT AND TRADEMARK OFFICE

CERTIFICATE OF CORRECTION

PATENT NO. : 5,901,859
DATED : May 11, 1999
INVENTOR(S) : CARR et al.

It is certified that error appears in the above-indentified patent and that said Letters Patent is hereby corrected as shown below:

IN THE DRAWINGS:

Please replace the sheet of drawings printed with the patent with the attached sheet of drawings containing Figures 1 and 2.

On the title page showing the illustrative figure, should be deleted and substitute therefor the attached title page.

Signed and Sealed this

Twenty-third Day of November, 1999

*Attest:*

Q. TODD DICKINSON

*Attesting Officer*

*Acting Commissioner of Patents and Trademarks*

US005901859A

United States Patent [19]

Carr et al.

[11] Patent Number: 5,901,859

[45] Date of Patent: May 11, 1999

[54] CARD DISPLAY UNIT AND METHOD

[75] Inventors: Arthur G. Carr, Washington, D.C.; Sally G. Bloomberg; David A. Hindin, both of 6612 Rosecroft Pl., Falls Church, Va. 22043

[73] Assignees: Sally G. Bloomberg; David A. Hindin, both of Falls Church, Va.

[21] Appl. No.: 08/922,380

[22] Filed: Sep. 3, 1997

[51] Int. Cl.[6] ..... A47F 7/16

[52] U.S. Cl. ..... 211/45

[58] Field of Search ..... 211/45; 403/217, 403/170, 174; 40/124, 124.4, 658, 666, 729, 730; 248/316.7; 24/300, 462

[56] References Cited

U.S. PATENT DOCUMENTS

| | | | |
|---|---|---|---|
| D. 253,540 | 11/1979 | Rothchild . | |
| 1,997,048 | 4/1935 | Demmy . | |
| 3,524,275 | 8/1970 | Korth . | |
| 3,528,559 | 9/1970 | Miller | 211/184 |
| 3,599,360 | 8/1971 | Lappo . | |
| 3,789,526 | 2/1974 | Lavinson . | |
| 3,797,795 | 3/1974 | Hemgren | 248/316.7 |
| 3,958,696 | 5/1976 | Leonas . | |
| 4,010,517 | 3/1977 | Kapstad | 211/45 |
| 4,017,991 | 4/1977 | Berger . | |
| 4,202,121 | 5/1980 | Maris et al. . | |
| 4,326,349 | 4/1982 | Daughtry . | |
| 4,475,659 | 10/1984 | Wells et al. . | |
| 4,486,032 | 12/1984 | Leahy . | |
| 4,493,495 | 1/1985 | Linn . | |
| 4,557,064 | 12/1985 | Thompson . | |
| 4,629,075 | 12/1986 | Hutten . | |
| 4,852,280 | 8/1989 | Beattie . | |
| 4,899,974 | 2/1990 | Wear et al. . | |
| 4,993,560 | 2/1991 | Jaffe . | |
| 5,088,216 | 2/1992 | Wasilko . | |
| 5,175,913 | 1/1993 | Mackie et al. . | |
| 5,275,367 | 1/1994 | Frye . | |
| 5,335,796 | 8/1994 | Sanford et al. . | |
| 5,480,036 | 1/1996 | Opar . | |
| 5,495,644 | 3/1996 | Mesher et al. . | |
| 5,509,634 | 4/1996 | Gebka et al. . | |
| 5,555,606 | 9/1996 | Chu . | |

FOREIGN PATENT DOCUMENTS

| | | |
|---|---|---|
| 2129296 | 5/1984 | United Kingdom . |

OTHER PUBLICATIONS

Catalog for World Plastic Extruders, Inc., Moonachie, New Jersey, pp. 2 and 3. (No date available.)

Catalog for Outwater Plastics Industries, Extrusion Supplement 1997, Wood–Ridge, New Jersey, entire catalog.

*Primary Examiner*—Alvin Chin-Shue
*Assistant Examiner*—Sarah Purol
*Attorney, Agent, or Firm*—Nixon & Vanderhye P.C.

[57] ABSTRACT

A display unit for displaying sheet materials includes a channel support member and a plurality of channel members connected to the channel support member. Each of the channel members includes a pair of channel arms defining a channel shape. The channel arms extend outward from the base point and converge at a contact point disposed between a base point and distal ends of the channel arms. The channel arms preferably diverge beyond the contact point such that the distal ends are flared. Preferably, the channel members are formed integral with the channel support member by being extruded or cast from a plastic or other material. The display unit has a simple construction and is thus easy and inexpensive to manufacture. The display unit can be used laying flat, standing vertically, or hanging. The display unit can display multiple items and the items can be of various sizes, shapes and orientations.

20 Claims, 1 Drawing Sheet

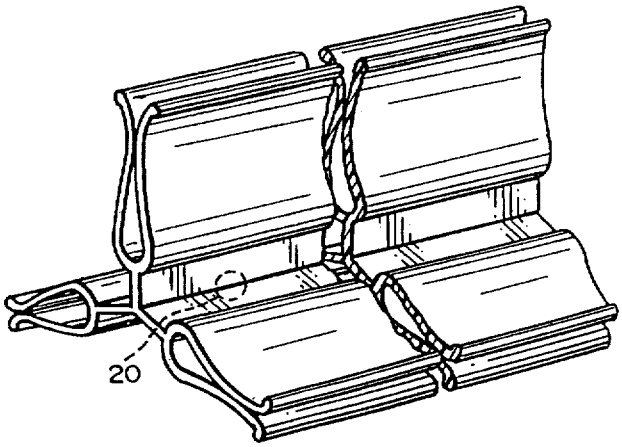

FIG. 1
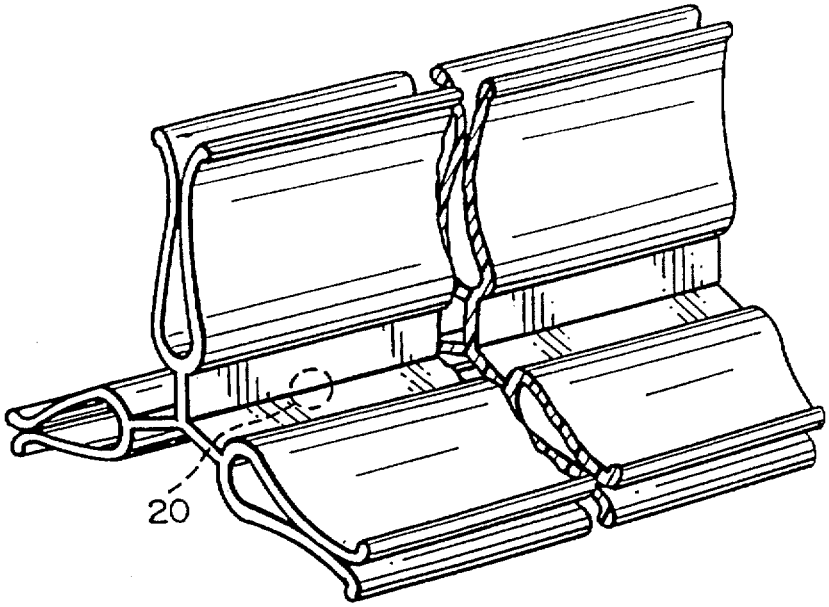
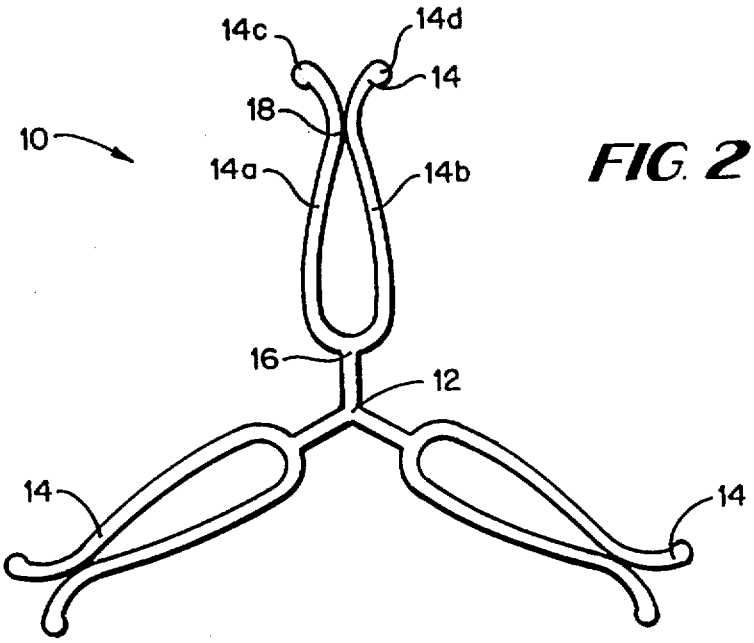
FIG. 2